US006036609A

United States Patent [19]

Gilman

[11] Patent Number: 6,036,609

[45] Date of Patent: Mar. 14, 2000

[54] BLOCKING PAD MOTION CONTROL APPARATUS

[75] Inventor: Neil F. Gilman, Glastonbury, Conn.

[73] Assignee: Marty Gilman, Inc., Gilman, Conn.

[21] Appl. No.: 09/130,202

[22] Filed: Aug. 4, 1998

[51] Int. Cl.[7] ..... A63B 69/34

[52] U.S. Cl. ..... 473/445

[58] Field of Search ..... 473/438, 441, 473/470, 442–445

[56] References Cited

U.S. PATENT DOCUMENTS

| | | | |
|---|---|---|---|
| 2,521,649 | 9/1950 | Paupa | 473/445 |
| 2,934,343 | 4/1960 | Schumacher | 473/445 |
| 3,514,105 | 5/1970 | Pillard | 473/441 |
| 3,684,283 | 8/1972 | Forrest | 473/445 |
| 3,997,160 | 12/1976 | George | 473/444 |
| 4,087,089 | 5/1978 | Forrest . | |
| 4,573,680 | 3/1986 | McNally . | |
| 4,688,795 | 8/1987 | Callaway, Jr. . | |
| 4,720,103 | 1/1988 | Palladino, Jr. | 473/438 |
| 4,943,057 | 7/1990 | Felder . | |
| 5,143,372 | 9/1992 | Wilson . | |
| 5,462,272 | 10/1995 | Staten . | |

*Primary Examiner*—Steven Wong
*Assistant Examiner*—Mitra Aryanpour
*Attorney, Agent, or Firm*—Kudirka & Jobse, LLP

[57] ABSTRACT

In a blocking training apparatus, a motion control apparatus for coupling intermediate the sled frame or surface and a blocking pad assembly enables movement of the blocking pad both horizontally and vertically, with variable degrees of resistance throughout the whole exercise. The disclosed apparatus includes a planar base having a pair of vertical castings extending upwards therefrom which define a pair of separate, noncontiguous, and nonparallel tracks, a travel plate movably mounted within the tracks and a source of resistance, such as a coil spring and/or shock absorber attached between the travel plate and the base. The tracks include a pair of rear tracks which extent parallel to the plane of the base and a pair of front tracks which extent along an incline with respect to the plane of the base, enabling the blocking pad assembly to be pushed first rearwardly and then upwardly to more closely mimic the body movements and momentum of an opponent during the blocking exercise.

20 Claims, 4 Drawing Sheets

BLOCKING PAD MOTION CONTROL APPARATUS

FIELD OF THE INVENTION

The invention relates generally to sports-related training equipment and devices. Particularly, in sports where the blocking of another player is permitted, such as in football, relevant devices include those which aid in training an athlete in how to physically block an opponent, wherein the training devices simulates the opponent.

BACKGROUND OF THE INVENTION

It is generally accepted that the better prepared a sports team is, the more successful they will be at the game. While many factors affect a team's preparedness, the training equipment available to a team has traditionally been considered critical. Consequently, training equipment has continued to evolve, as players and teams attempt to gain a competitive advantage over opponents. This evolution has resulted in a closer approximation of "game-like" conditions for the athletes during practices. Simulating game-like conditions has allowed the players to finely tune their skills in ways that directly translate into increased "on-field" performance.

One sport that has traditionally relied heavily on a variety of training equipment for simulating game-like conditions is football. In football, it is a common belief that to control a football game, a team must control the line of scrimmage. Controlling the line of scrimmage entails, in most cases, blocking the opponent by thrusting them rearwards, i.e., in the direction the team wishes to advance. In accordance with this premise, if the team on offense controls the line of scrimmage, i.e., effectively blocks, its quarterback is given ample time to throw the football to a receiver or, alternatively, a running-back is given ample room to maneuver and gain yardage before being tackled by opponents. On defense, controlling the line of scrimmage results in pressure being applied to the quarterback or a running-back before significant yardage, if any at all, can be gained by the offense.

To simulate game-like blocking conditions in football, "blocking sleds" and other similar training mechanisms have been developed, and are used at many levels of play, from school age children to professionals. Such devices usually include a pad attached to some type of frame or mechanism, which offers resistance to the player's thrust. These devices simulate an opponent's momentum with varying degrees of accuracy. In some cases, a blocking sled comprises a pad affixed to a rigid frame which a player thrusts rearward, opposed by the weight of the sled and the resistance between the sled and the ground. In other cases, the blocking pad is affixed to a movable mechanism within a sled or trainers, which controls the motion of the pad relative to the apparatus itself to enhance the simulation of the opponent's momentum and body movement during blocking. For example, a typical training exercise with a blocking apparatus involves a player, e.g., a lineman, striking the pad as though he were blocking the opponent and thrusting the apparatus and pad. Examples of football blocking training devices which provide movable horizontal resistance, substantially parallel to the ground and opposite to the trainees' momentum include U.S. Pat. No. 4,943,057. Such devices, provide resistance generally along a single axis which, unfortunately, does not accurately mimic the momentum and body movements of an opposing player during a blocking event. It is common for an opponent, initially in a crouched position, to rise up vertically from the crouch position while simultaneously providing forward momentum which must be resisted. Accordingly, other blocking training devices have attempted to provide a trainee with a blocking target which provides resistance along both a horizontal and a vertical axis relative to the ground, including U.S. Pat. Nos. 4,720,103; 5,462,272 and 5,143,372.

In U.S. Pat. No. 5,462,272, Staten, a blocking device is disclosed in which the pad is moved horizontally a predetermined distance until a latch is released allowing the arm to which the pad is telescopically mounted, to be pivoted in an upward, arcuate path. Unfortunately, during a scrimmage event, the opponent will be resisting a player with momentum having both horizontal and vertical components immediately at the onset, not after the component has been pushed rearwardly a fixed, predetermined distance. In addition, the upward momentum of the opponent's mass is not likely to follow a predefined arcuate path, as with the pivoted arm and the pivoted a blocking pads disclosed in U.S. Pat. Nos. 5,462,272 and 5,143,372.

Further, the device disclosed in the Staten patent is completely integrated with the frame and sled of the blocking mechanism. Because of the expense associated with football training equipment, and, given the sometimes-limited financial resources of educational institutions for purchasing such equipment, the purchase of new, more modern blocking devices is not always realistic. Many organizations desire a low cost and efficient way to upgrade their existing legacy equipment without having to buy a new blocking training device.

Accordingly, a need exists for a mechanism which more realistically mimics both the horizontal and vertical components of an opponent's momentum during a scrimmage event.

An additional need exists for a mechanism which enables a blocking training device to more realistically mimic the momentum of an opponent's resistance and which can be integrated into the large number of legacy blocking training devices without requiring complete replacement thereof.

A further need exists for an apparatus which may be completely integrated into a blocking training mechanism both cheaply and efficiently.

SUMMARY OF THE INVENTION

The present invention discloses a motion control apparatus, coupled intermediate a blocking sled frame or other surface and a blocking pad assembly, which enables movement of the blocking pad both horizontally and vertically, with variable degrees of resistance throughout the whole blocking exercise. The disclosed apparatus includes a planar base having a pair of vertical castings extending upwards therefrom which define pairs of separate, noncontiguous, and nonparallel tracks. A travel plate is movably mounted within the tracks and a source of resistance, such as a coil spring and/or shock absorber is attached between the travel plate and the base. The tracks include a pair of rear tracks which extend parallel to the plane of the base and a pair of front tracks which extend along an incline with respect to the plane of the base, enabling the blocking pad assembly to be pushed first rearwardly and then upwardly to more closely mimic the body movements and momentum of an opponent during the blocking exercise.

According to a first aspect of the invention, an apparatus for selectively controlling the horizontal and vertical motion of a blocking pad during a blocking event comprises a travel plate to which a blocking pad may be operatively coupled, a base adapted to be attached to a surface and defining a plurality of tracks into which the travel plate may be movably mounted so as to enable movement of the travel plate along the tracks in directions both parallel and non parallel to the base, and resistive means, coupled to the travel plate and the base, for resisting movement of the travel plate within the tracks when force is exerted on the blocking pad.

According to a second aspect of the invention, a method for controlling the motion of a blocking pad assembly during a blocking event, the blocking pad assembly mounted to a flexible, force-transmitting arm, comprises the steps of (a) rigidly mounting one end of the arm to a travel plate; (b) movably mounting the travel plate within a base, the base defining a plurality of tracks which enable movement of the travel plate along the tracks in directions both parallel and nonparallel to the base; and (c) coupling a resistive device between the travel plate and the base so as to provide selective resistance to movement of the travel plate within the tracks when force is exerted on the blocking pad.

According to a third aspect of the invention, a blocking motion control apparatus, attachable to a blocking sled frame or surface and capable of having a blocking pad operatively coupled thereto, comprises a travel plate attachable to a blocking pad assembly; a planar base having a pair of vertical castings extending upwards therefrom, the casting collectively defining a first pair of tracks and a second pair of tracks into which the travel plate is movably mounted, the travel plate movable along the first pair of tracks in a direction parallel to the plane of the base and further movable along the second pair of tracks in a direction nonparallel to the plane of the base; a front resistive mount, attached to the castings and attachable to a resistive means; a rear resistive mount, attached to the travel plate and attachable to the resistive means; and resistive means, couple to the front resistive mount and rear resistive mount, for selectively resisting movement of the travel plate within the track.

BRIEF DESCRIPTION OF THE DRAWINGS

The above and further advantages of the invention may be better understood by referring to the descriptions herein, in conjunction with the accompanying drawings described below.

DETAILED DESCRIPTION OF THE ILLUSTRATIVE EMBODIMENT

Figure 1:
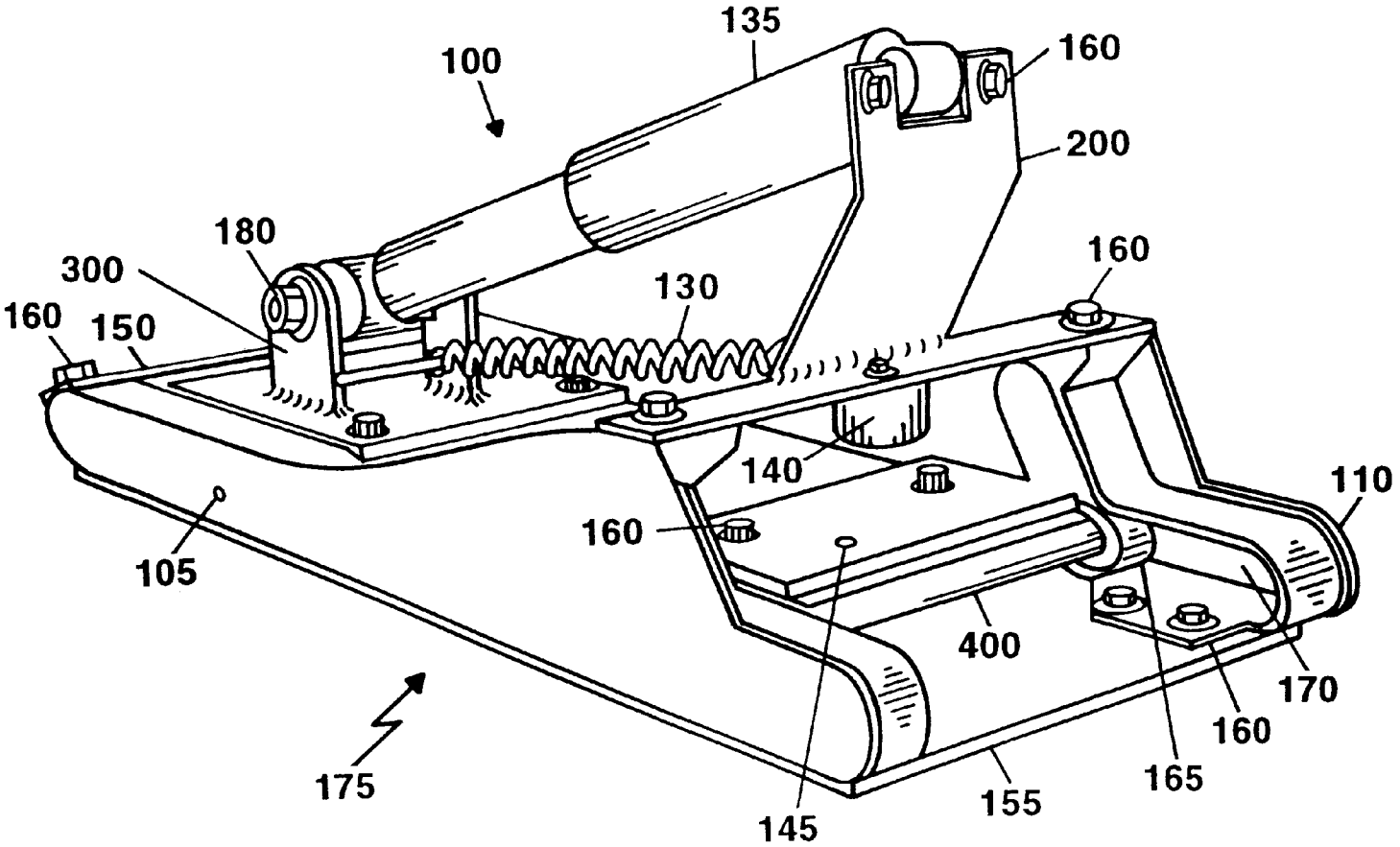
FIG. 1 is a diagram of the motion control apparatus in accordance with the illustrative embodiment.

FIG. 1 shows the blocking motion control apparatus 100 of the illustrative embodiment. Apparatus 100 comprises a base 175, a front shock mount 200 attached to base 175, a travel plate 400 movably mounted within base 175, a rear shock mount 300 mounted to travel plate 400, and a coil spring 130 and shock absorber 135 mounted between front shock mount 200 and rear shock mount 300 so as to provide resistance against movement of travel plate 400 within base 175, as explained hereinafter in greater detail.

Base 175 comprises a base plate 155, left and right side castings 105 and 110, respectively, each defining rear and front casting tracks, and a base bar 150 for rigidly maintaining the right and left castings in a fixed relation. The rigid, planar base plate 155 serves as the foundation for base 175 and may be implemented with a flat steel bar. Attached to the base plate 155 and extending vertically upward therefrom are left side casting 105 and right side casting 110. Each of left and right castings 105, 110, respectively, define a front casting track 170 and a rear casting track 172, not shown in FIG. 1. In the illustrative embodiment, castings 105 and 110 may comprise aluminum secured to base plate 155 with bolts 160 , as illustrated. Rear casting track 172 may have a length of approximately 4 inches and is substantially parallel to the plane of base plate 155. In the illustrative embodiment, front casting track 170 may have a length of approximately 3 inches and is inclined upwards at approximately 25 degrees from the plane of base plate 155. Base 175, therefore, defines a pair of front tracks and a pair of rear tracks which, together, serve as guides for travel plate 400 to move in directions both parallel and non parallel to the plane of base 175, as described hereinafter. Base 175 may be removably secured to a stationary surface or to the frame of an existing blocking sled.

Figure 2:
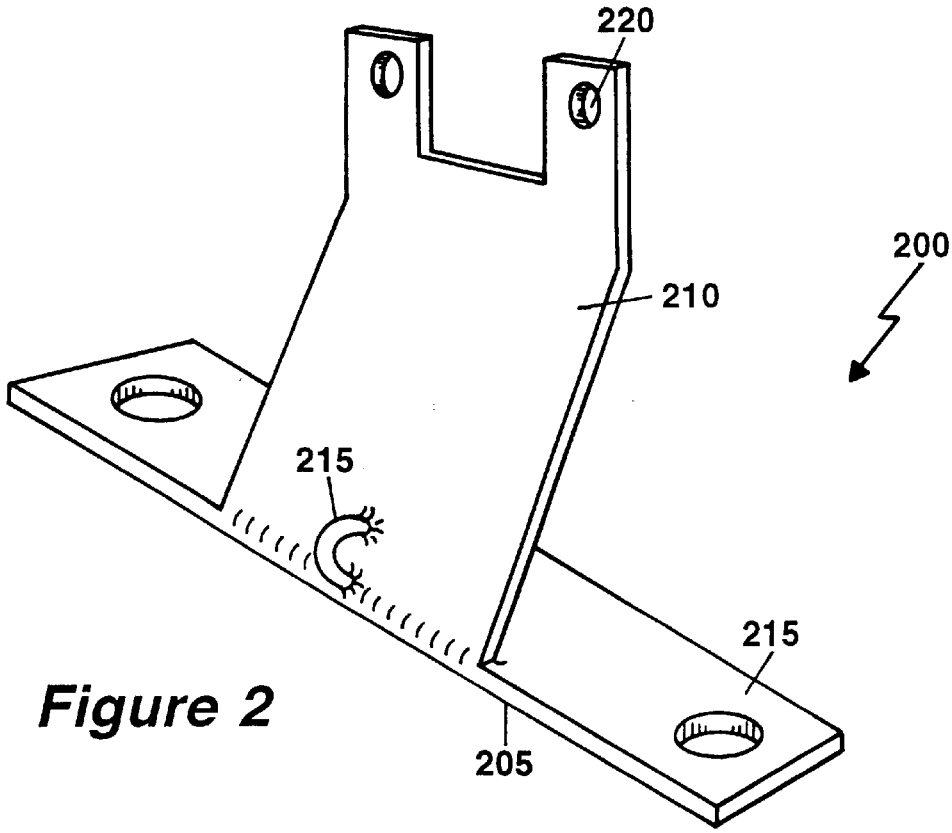
FIG. 2 is an illustration of the front shock mount of the illustrative embodiment.

A front shock mount 200 affixes to the left and right casting 105, 110 toward a front portion of the castings. A more detailed view of the front shock mount 200, is shown in FIG. 2. The front shock mount 200 comprises a base support 205, a rigid bracket 210 and a spring mount 215, all of which may be formed of steel and integrally formed into a rigid unitary component by welding or other means. Base support 205, may be implemented as a flat steel bar having bolt holes defined therein for securing the front shock mount 200 to the top of the castings 105, 110 of FIG. 1. The base support 205, may be affixed to castings 105 and 110 by bolts 160, thereby enhancing the rigidity of the structure 100. An arcuate spring mount 215, is securely attached to a rigid bracket 210, which extends upward from the base support 205. The spring mount 215 provides a mechanism to which the spring 130 of FIG. 1 may be attached. Openings 220 formed at the top of bracket 210, provide a means by which the shock absorber 135 of FIG. 1, may be attached to the front shock mount 200. In the illustrative embodiment, front shock mount 200 is a substantially rigid, unitary component in which base support 205, bracket 210 and spring mount 215 are integrally formed by welding or other suitable means, as illustrated in the drawings. Alternatively, the components comprising mount 200 may be secured together by bolts or screws or may be integrally formed in cast metal.

Figure 3:
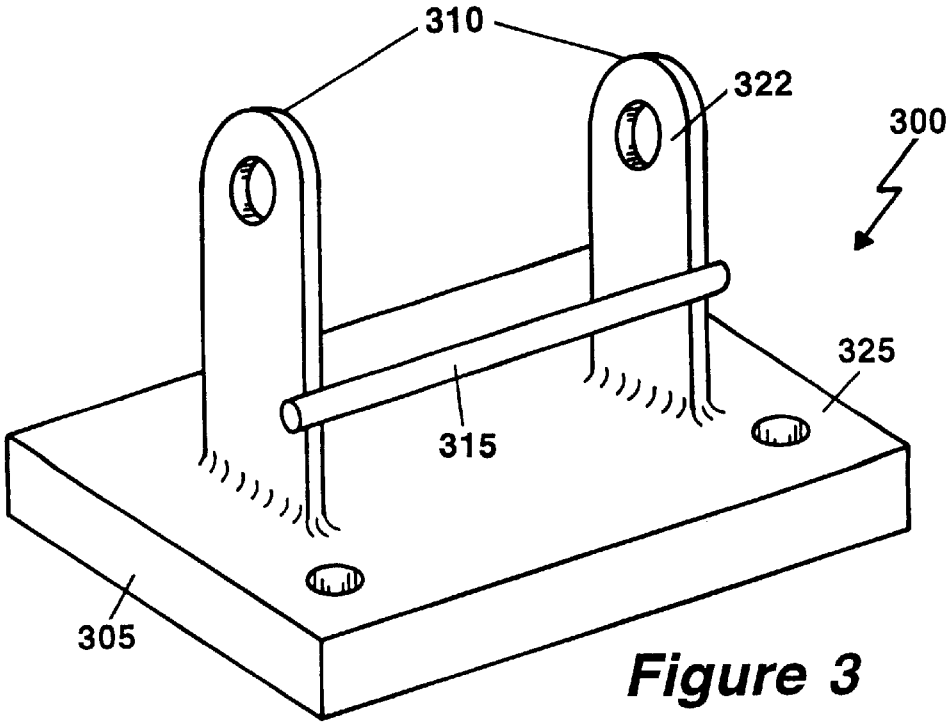
FIG. 3 is an illustration of the rear shock mount of the illustrative embodiment.

FIG. 3 shows a more detailed view of the rear shock mount 300. Rear shock mount 300 comprises a base support plate 305, left and right brackets 310 and 320, respectively, and spring mount bar 315, all of which may be formed of steel and integrally formed into a rigid unitary component by welding or other means. Base support 305 is substantially rectangular in shape and has a thickness of approximately ⅜" inches. A pair of openings 325 are defined in base support 305 as shown, through which bolts are used to affix the rear shock mount 300 to the travel plate 400 of FIG. 1. Left and right brackets 310 and 320, respectively extend vertically upward from base support 305. In the illustrative embodiment, bracket 310 and 320 are substantially parallel to each other and perpendicular to base support 305. Additionally, each bracket 310 defines an pening 322 used to attach the shock absorber 135, FIG. 1, to the rear shock mount 300. In the illustrative embodiment, the shock absorber 135, FIG. 1, includes two bolts, wherein each bolt fits through a separate one of the two openings 322, such that a nut can then be used to secure the shock absorber bolts to the rear shock mount 300. Positioned below the openings 322 is a spring mount bar 315, which extends from the left bracket 310 to the right bracket 310. The spring bar 315 provides a support to which the spring 130 of FIG. 1 may be secured to the rear shock mount 300. The rear shock mount 300, is securely attached to the travel plate 115, so that the rear shock mount moves when pressure is exerted on a blocking pad attached to the apparatus 100.

Figure 4:
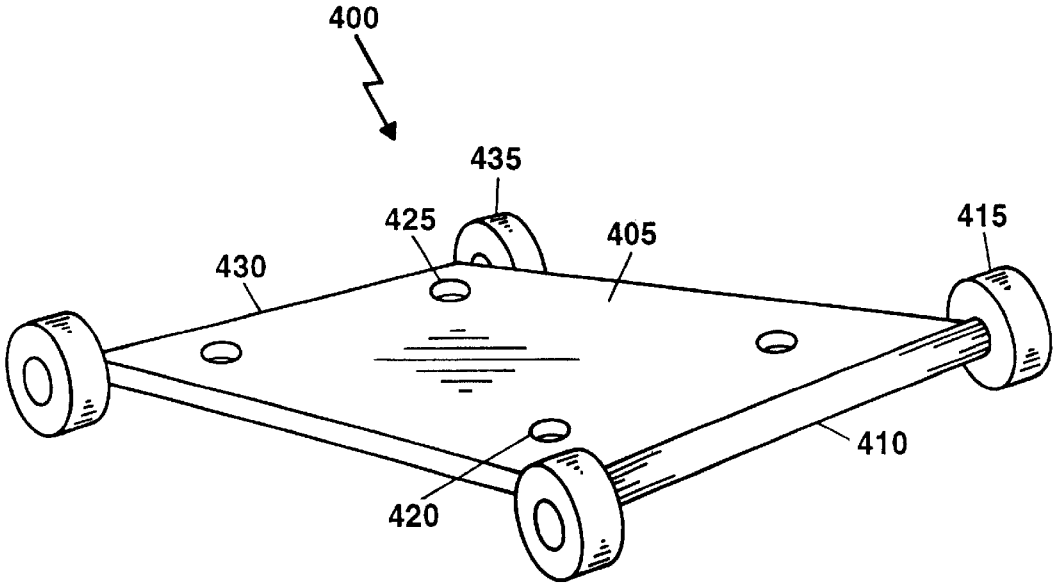
FIG. 4 is an illustration of the travel plate of the illustrative embodiment.

The travel plate 400 is shown in detail in FIG. 4. Travel plate 400 comprises a base travel plate 405, front and rear axles 410 and 430, respectively, and front and back pairs of roller bearings 415 and 435, respectively. In the illustrative embodiment, base travel plate 405 is a rectangular steel plate. Within base travel plate 405 a pair of securing holes 425 are defined which allow attachment of the rear shock mount 300 near the rear end of travel plate 400. A second pair of securing holes 420 allows for attachment of a blocking pad assembly near the front end of the travel plate 400.

As shown in FIG. 4, the front end of the base travel plate 405 has affixed thereto a rigid front axle 410. Similarly, a rigid rear axle 430 is affixed to the rear end of travel plate 405. As illustrated, proximate and secured to axles 410 and 430 are rotatably mounted wheels which may be implemented with roller bearings 415 and 435, respectively. Roller bearings 415 are attached to each end of front axle 410 in a manner which allows the roller bearings to rotate relative to the base travel plate 405. Similarly, roller bearings 435 are attached to each end of rear axle 410 in a manner which allows the roller bearings to rotate relative to the base travel plate 405. When the apparatus 100 is assembled, the front roller bearings 415 are inserted into the front casting tracks 170 and the rear roller bearings 435 are inserted into the rear casting tracks 172. As a result, base travel plate 405 is allowed to move relative to the castings through the rotation of the wheels within the casting tracks.

Spring plate 445 is attached to travel plate 400 via securing holes 420 and bolts 160. In the illustrative embodiment, spring plate 445 may comprise a flat steel plate. A force transferring mechanism, such as a flat steel leaf spring, may be rigidly mounted between spring plate 445 and base travel plate 405.

Additionally, a stopper 140, comprised of either a natural or synthetic force absorbing material, is secured to the bottom of front shock mount 200 to buffer any impact of the leaf spring or other force transferring mechanism against the bottom of shock mount 200.

Apparatus 100 is assembled by mounting right and left castings 105 and 110, respectively, to base plate 155 and further securing castings 105 and 110 to a plate bar 150, as illustrated in FIG. 1. Front shock mount 200 is then secured to the tops of castings 105 and 110 with bolts 160, as illustrated in FIG. 1. Rear shock mount 300 is secured to travel plate 400 with bolts 160, as illustrated, and roller bearings 415 and 435 secured to axles 410 and 430 of travel plate 400, respectively. Travel plate 400 is then inserted into base 175 so the right or left sets of rollers 165 rest within their respective front and rear casting tracks. The second of the right or left casting is then secured to base plate 155 so that travel plate 400 is movably contained within the confines of the front and rear casting tracks. Front shock mount 200 and plate 150 are then secured to the left and right castings. Shock absorber 135 is then secured to top bracket 210 of front shock mount 200 and right and left brackets 310 of rear shock mount 300. A coil spring 130 is then affixed between spring mount bar 315 and spring mount 215. Finally, stopper 140 is affixed to the bottom surface of front shock mount 200. It will be obvious to those reasonably skilled in the art that the exact order in which the components of apparatus 100 are assembled may be modified to achieve maximum efficiency.

In an assembled state, apparatus 100 may be mounted to a blocking sled frame 555 or other surface, including a stationary surface. In addition, travel plate 400 and spring plate 450 may be mounted on adjacent sides of a flat leaf spring or other apparatus which is capable of transferring force from a blocking pad 505. In the illustrative embodiment, blocking pad 505 is attached to a leaf spring 510 which is secured to travel plate 400. A blocking pad and leaf spring assembly suitable for use with the present invention is commercially available from Marty Gilman, Inc. of Gilman, Conn., Model Nos. T, V SVP, or SBOD. Additionally, a blocking sled suitable for use with the present invention and to which apparatus 100 may be mounted is also commercially available from Marty Gilman, Inc., Model Nos. INRAM, RAM2, RAM3, RAM5, and RAM7. Further, an embodiment of the invention is commercially available from Marty Gilman, Inc. known as the RAMBACK™ mechanism, Model RAM.

Figure 5A:
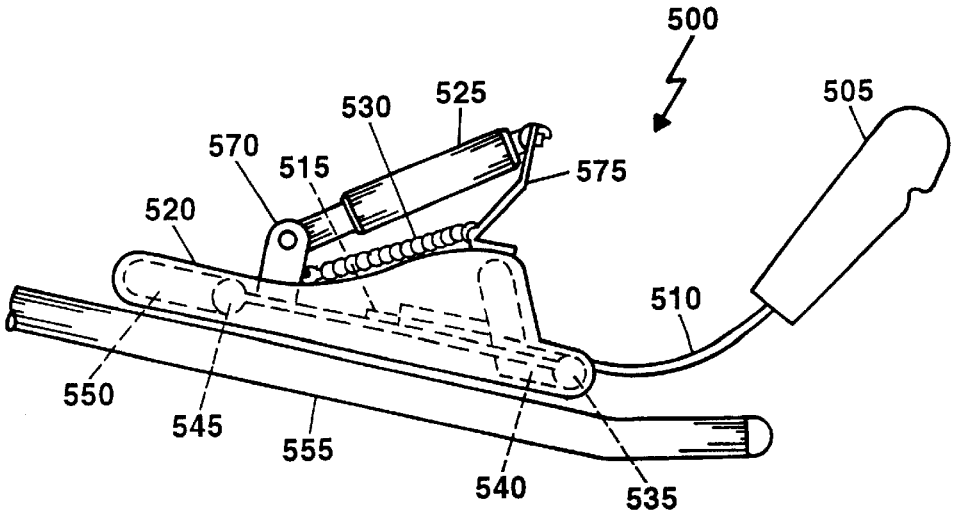
FIGS. 5A, B and C depict the motion of the travel plate relative to a blocking sled when secured thereto, in accordance with the illustrative embodiment.
Figure 5B:
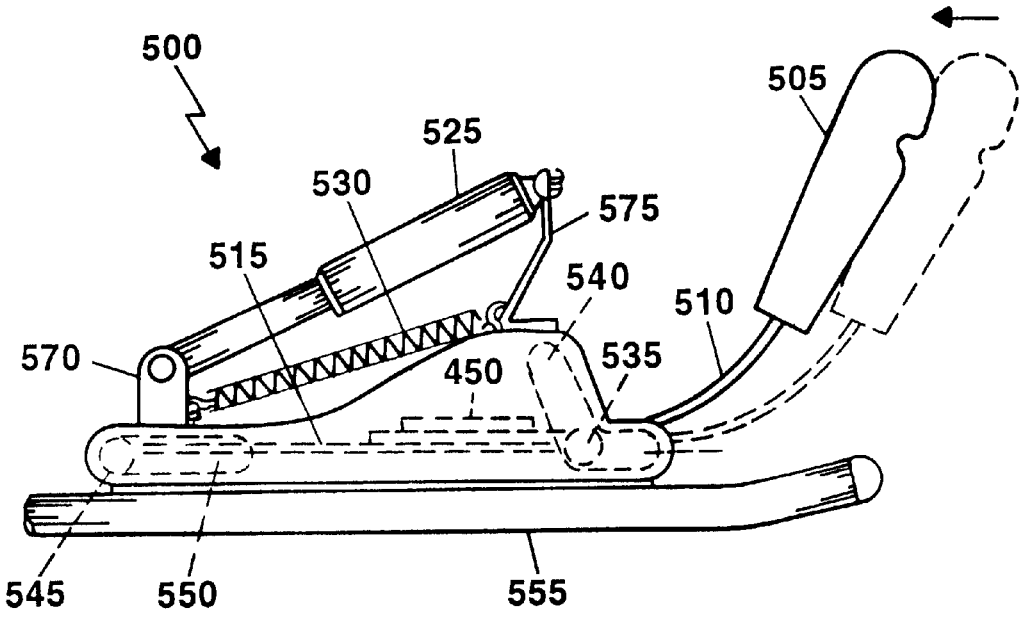

The operation of the inventive blocking motion control apparatus are explained with reference to FIGS. 5A–C, certain components of the apparatus being illustrated in phantom. FIG. 5A depicts an apparatus 500 in a resting state, with a blocking pad 505 attached to the travel plate 515 via leaf spring 510. In this state, the travel plate 515 rests in its front-most position. Accordingly, wheels 545 and 535 are at the front-most portion of the casting tracks 550 and 540, respectively. Also, shock absorber 525 and coil spring 530 remain in a generally compressed state.

The operation of apparatus 100 occurs as follows. As the blocking event begins, the trainee exerts force on blocking pad 505 generally in the direction of the arrow, as illustrated in FIG. 5B, but also in a vertical direction as well. The force exerted on blocking pad 505 is translated via leaf sprint 510 to travel plate 515 causing travel plate 515 to roll within the casting tracks 550 and 540 in a rearward direction. Because of the flexibility of leaf spring 510, blocking pad 505 may be moved, to a limited extent, vertically upward during the initial part of the blocking event. As the trainee exerts enough force to overcome the resistance of spring 530 and shock absorber 525, travel plate 515 begins to move rearwardly within the casting tracks of the apparatus base. FIG. 5B depicts apparatus 500 at approximately halfway through the blocking event in which travel plate 515 is displaced completely along the rear casting tracks 550 and through the first segment of the front casting tracks 540. As illustrated, rear bearings 545 have come to rest at the rear extreme of rear casting tracks 550 while front bearings 535 are resting at the entrance at the inclined segment of the front casting tracks 540. Note, once rear wheels 545 have reached the back of rear casting inserts, spring 530 and shock absorber 525 are expanded to the maximum extent allowable within the apparatus 500. Thereafter, an equal or greater force must be exerted on blocking pad 505 in order to achieve upward motion of blocking 505 and leaf spring 510, such resistance more closely mimicking the momentum of an opponent player in a scrimmage event.

Figure 5C:
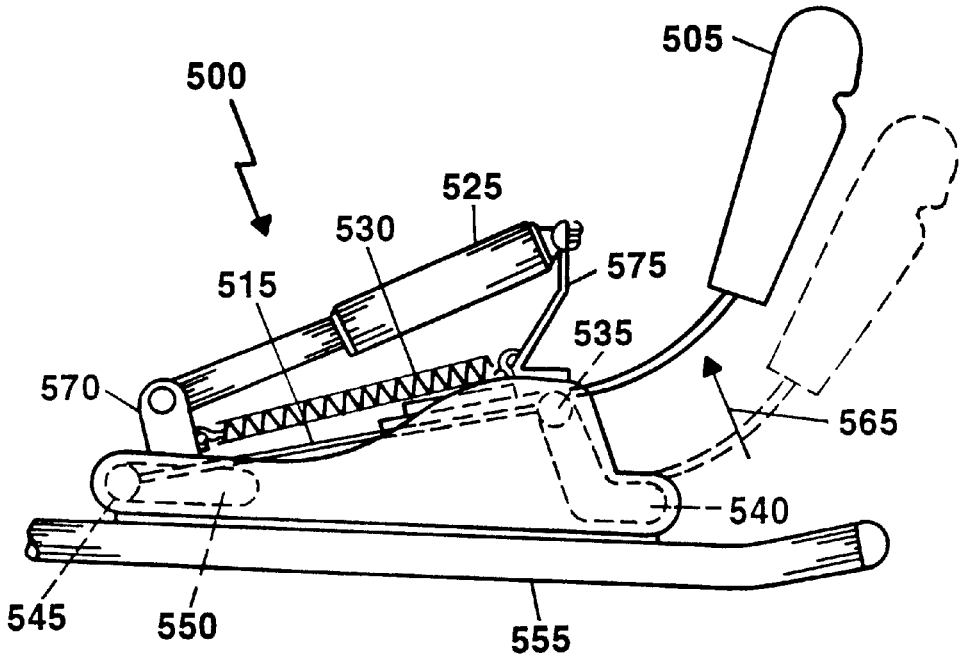

Continued exertion of force on the blocking pad 505, depicted by arrow 565, causes the front of the travel plate 515 to ascend, with front wheels 535 moving up the second segment of the front casting tracks, as shown in FIG. 5C. The position of the blocking pad 505 in the intermediate position of FIG. 5B is illustrated in phantom in FIG. 5C. Rear wheels 435, having reached the rear end of the rear casting tracks 550 when the blocking pad was in the intermediate position, remain in that position throughout the traversal of the front wheels 535 up the inclined, second segment of the front casting tracks 540. The travel plate 515 ultimately comes to rest relative to the castings when the front wheels 535 reach the top of the incline segment of the front casting tracks 540. When force is removed from blocking pad 505, the forces of gravity and retraction forces, from the expanded coil spring 530 and shock absorber 525 returning to their compressed states, return the travel plate 515 to the original position illustrated in FIG. 5A.

While the invention has been shown and described with reference to an illustrative embodiment thereof, it will be understood by those skilled in the art that various changes in form and detail may be made herein without departing from the spirit and scope of the invention as defined by the appended claims. For example, rather than wheels, inserts in the form of pins which glide through the tracks with the aid of a lubricant and/or smooth surfaces. Additionally, rather than using both a shock absorber and a spring, it may be possible to achieve the resistive force by expanding or compressing only one such device. In addition the apparatus may be adapted to receive other than a flat leaf spring to which the blocking pad is attached. Also, variations, e.g., length or angle of inclination, in the configuration of the casting tracks could be implemented to change the character of the motion control created by the apparatus. Such modifications to the inventive concept are intended to be covered by the appended claims.

What is claimed is:

1. An apparatus for selectively controlling the horizontal and vertical motion of a blocking pad during a blocking event comprising:

a travel plate to which a free-standing blocking pad may be operatively coupled;

a modular base extending along a plane and adapted to be attached to a surface, the base further defining a plurality of nonparallel tracks into which the travel plate may be movably mounted so as to enable movement of the travel plate along the tracks in directions both parallel and nonparallel to the plane of the base; and resistive means, coupled to the travel plate and the base, for resisting movement of the travel plate within the tracks when force is exerted on the blocking pad.

2. The apparatus of claim 1 in combination with a blocking pad operatively coupled to the travel plate.

3. The apparatus of claim 2 in combination with a leaf spring coupled intermediate the blocking pad and the travel plate.

4. The apparatus of claim 1 in combination with a rigid frame to which the base is mounted.

5. The apparatus of claim 1 further in combination with a flat surface to which the base is mounted.

6. The apparatus of claim 1 in which the resistive means comprises a shock absorber device.

7. The apparatus of claim 1 in which the resistive means comprises a coil spring.

8. The apparatus of claim 1 in which the base defines a first pair of tracks and a second pair of tracks.

9. The apparatus of claim 8 wherein at least one of the pairs of tracks extends in a direction nonparallel to the plane of the base.

10. The apparatus of claim 9 wherein at least another of the pairs of tracks extends in a direction parallel to the plane of the base.

11. The apparatus of claim 1 in which the travel plate further comprises front and rear axle projections.

12. The apparatus of claim 11 wherein wheels are rotatably mounted on selected of the axle projections.

13. The apparatus of claim 12 wherein the travel plate is movably mounted within the base so that the wheels may roll within the tracks.

14. A method for controlling the motion of a blocking pad assembly during a blocking event, the blocking pad assembly mounted to a flexible, force-transmitting arm, the method comprising the steps of:

(a) rigidly mounting one end of the arm to a travel plate;

(b) movably mounting the travel plate within a base, the base defining a plurality of nonparallel tracks which enable movement of the travel plate along the tracks in directions both parallel and nonparallel to the plane of the base; and (c) coupling a resistive device between the travel plate and the base so as to provide selective resistance to movement of the travel plate within the tracks when force is exerted on the blocking pad.

15. A blocking motion control apparatus, attachable to a blocking sled and capable of having a blocking pad operatively coupled thereto, the apparatus comprising:

a travel plate attachable to a blocking pad assembly;

a planar base having a pair of vertical castings extending upwards therefrom, the castings having an elongate pair of cavities collectively defining a first pair of tracks and a second pair of tracks into which the travel plate is movably mounted, the travel plate movable along the first pair of tracks in a direction parallel to the plane of the base and further movable along the second pair of tracks in a direction nonparallel to the plane of the base; and resistive means, coupled to the travel plate and the base, for selectively resisting movement of the travel plate within the tracks.

16. The apparatus of claim 15 further comprising:

a front resistive mount, attached to the right and left castings and attachable to a resistive means.

17. The apparatus of claim 15 further comprising:

a rear resistive mount, attached to the travel plate and attachable to the resistive means.

18. An apparatus for selectively controlling the horizontal and vertical motion of a blocking pad during a blocking event comprising:

a blocking pad;

a travel plate coupled to the blocking pad via a leaf spring;

a base extending along a plane and adapted to be attached to a surface, the base further defining a plurality of nonparallel tracks into which the travel plate may be movably mounted so as to enable movement of the travel plate along the tracks in directions both parallel and nonparallel to the plane of the base; and resistive means, coupled to the travel plate and the base, for resisting movement of the travel plate within the tracks when force is exerted on the blocking pad.

19. An apparatus for selectively controlling the horizontal and vertical motion of a blocking pad during a blocking event comprising:

a travel plate to which a blocking pad may be operatively coupled;

a base extending along a plane and adapted to be attached to a surface, the base further defining a plurality of nonparallel tracks into which the travel plate may be movably mounted so as to enable movement of the travel plate along the tracks in directions both parallel and nonparallel to the plane of the base; and a coil spring, coupled to the travel plate and the base, for resisting movement of the travel plate within the tracks when force is exerted on the blocking pad.

20. A blocking motion control apparatus, attachable to a blocking sled and capable of having a blocking pad operatively coupled thereto, the apparatus comprising:

a travel plate attachable to a blocking pad assembly;

a planar base having a pair of vertical castings extending upwards therefrom, the castings collectively defining a first pair of tracks and a second pair of tracks into which the travel plate is movably mounted, the travel plate movable along the first pair of tracks in a direction parallel to the plane of the base and further movable along the second pair of tracks in a direction nonparallel to the plane of the base; and resistive means, coupled to the travel plate and the base, for selectively resisting movement of the travel plate within the tracks; and a resistive mount, attached to the right and left castings and attachable to a resistive means.

* * * * *